US006408494B1

(12) United States Patent
Anscher

(10) Patent No.: US 6,408,494 B1
(45) Date of Patent: Jun. 25, 2002

(54) THREE-WAY PUSH RELEASE BUCKLE HAVING IMPROVED LATCHING CAPABILITY

(76) Inventor: Joseph Anscher, 1928 Midlane Rd., Muttontown, NY (US) 11791

( * ) Notice: Subject to any disclaimer, the term of this patent is extended or adjusted under 35 U.S.C. 154(b) by 0 days.

(21) Appl. No.: 09/516,977

(22) Filed: Mar. 1, 2000

(51) Int. Cl.[7] ..... A44B 11/26

(52) U.S. Cl. ..... 24/625; 29/579.11; 29/614

(58) Field of Search ..... 24/631, 632, 573.1, 24/573.5, 614–616, 633, 640, 625, 579.11; 297/468, 483, 484; 2580/801.1, 808

(56) References Cited

U.S. PATENT DOCUMENTS

| | | | | |
|---|---|---|---|---|
| 4,457,052 | A | | 7/1984 | Hamber |
| 4,559,679 | A | | 12/1985 | Downey |
| 4,679,282 | A | | 7/1987 | Feng |
| 4,682,390 | A | | 7/1987 | Parrish |
| 4,757,579 | A | | 7/1988 | Nishino et al. |
| 4,802,262 | A | | 2/1989 | Kasai |
| 4,928,364 | A | | 5/1990 | Ikeda |
| 5,113,556 | A | | 5/1992 | Murai et al. |
| 5,222,279 | A | | 6/1993 | Frano et al. |
| 5,380,238 | A | | 1/1995 | Crew-Gee |
| 5,533,240 | A | | 7/1996 | Murai |
| 5,542,161 | A | | 8/1996 | Anscher |
| 5,551,131 | A | | 9/1996 | Anscher |
| 5,604,964 | A | * | 2/1997 | Aoshima |
| 5,659,931 | A | | 8/1997 | Anscher |
| 5,709,014 | A | | 1/1998 | Takahashi |
| 5,794,316 | A | * | 8/1998 | Anscher |
| 6,061,883 | A | * | 5/2000 | Uehara |
| 6,170,133 | B1 | * | 1/2001 | Uehara |

FOREIGN PATENT DOCUMENTS

| | | |
|---|---|---|
| CH | 676316 | 1/1991 |
| DE | 39 30 604 | 3/1990 |
| EP | 0 256 398 | 2/1988 |
| EP | 0 309 943 | 4/1989 |
| FR | 1 298 012 | 5/1962 |
| GB | 1 371 152 | 10/1974 |
| GB | 2 150 632 | 7/1985 |
| JP | 59-72912 | 5/1984 |
| JP | 7-246106 | 9/1995 |

* cited by examiner

*Primary Examiner*—James R. Brittain
(74) *Attorney, Agent, or Firm*—Kenyon & Kenyon

(57) ABSTRACT

A three-way buckle having a socket member and a pair of plug members which may be coupled to the socket member, wherein the latching surfaces on the plug members are defined in resiliently flexible legs which extend from the base of the plug members. The socket member includes stopping members for engaging the latching surfaces of the legs in order to lock the plug members to the socket member. The plug members are simultaneously releasable from the socket because of the presence of a flap or button which is defined in a top wall of the socket. The button includes a pair of releasing members, one releasing member for each pair of legs, which as they are pushed down into the socket are forced into a space between the legs, thereby forcing the flexible legs to bend outwardly. As the legs are forced outwardly, eventually their latching surfaces clear the stopping members and the plug members are released from the socket. The resiliently flexible nature of the legs will provide a gentle force upon disengagement of the latching surfaces from the post which causes each plug member to spring out of the socket.

27 Claims, 9 Drawing Sheets

THREE-WAY PUSH RELEASE BUCKLE HAVING IMPROVED LATCHING CAPABILITY

BACKGROUND OF THE INVENTION

1. Field of the Invention

The invention relates to a buckle which attaches straps in three different directions, wherein the buckle is disengaged or opened by pushing on a centrally located button or flap. More particularly, the invention relates to such a buckle having an improved latching capability.

2. Description of Related Art

Buckles for attaching straps in three different directions are known in the art. For example, my U.S. Pat. No. 5,659,931 is directed to a three-piece buckle in which a centrally disposed socket member receives a pair of plug members through open opposite ends thereof. Each of the plug members has a cross bar which is adapted to attach a strap. The socket member also defines a cross bar, but in a direction which is perpendicular to the cross bars in the plug members, for attaching a third strap in a direction which is perpendicular to the straps attached by the plug members. The socket member defines a channel therethrough which is adapted to receive a portion of the plug members when the three buckle pieces are coupled to one another. Each plug member has a tongue which extends from a base portion thereof. The tongue is adapted to be received through an open end of the socket member. Each tongue defines a latching surface, e.g. a stopping member, on it which is adapted to engage with a stopping member in the socket. The tongues are resiliently flexible, so that as they slide into the socket member their latching surfaces can snap onto the stopping members inside the socket and thereby lock the buckle in a closed position.

The three-piece buckles of the prior art are released by pushing down on a button or flap which is defined in the central region of the socket member. The flap pushes down on the resiliently flexible tongues so as to disengage the latching surfaces of the tongues from the stopping members in the socket, thereby releasing the plug members from the socket. A pair of legs, which run parallel to the tongue on opposite sides thereof in each plug member, facilitate removal of the plug members from the socket because they flex inwardly when they are inserted into the socket and thereby urge the plug members out of the socket when they are released by depression of the center push button. However, the legs do not function or cooperate in any way to latch or lock the plug members in the socket. The latching function is performed exclusively by the tongues and the stopping members in the socket.

Three-piece buckles of the aforementioned type have enjoyed great commercial success in the market because they permit straps to be attached in three different directions, which makes them particularly suitable for use in children's seating products, especially high chairs and baby carriages. Furthermore, the center button release feature allows for simultaneous release of both plug members from the socket, and is favored by consumers over three-piece buckles wherein the pieces must be released individually.

U.S. Pat. No. 5,709,014 discloses a similar three-piece, simultaneous release buckle which may be used for children's seating. The buckle includes a pair of plug members, each having a tongue which is adapted to be inserted into opposite open ends of a centrally disposed socket member. Each tongue defines a latching surface at its distal end which is adapted to engage with an engagement member inside the socket for locking the buckle pieces together. A centrally disposed button or flap defined in a top wall of the socket member may be pushed down on the tongues to disengage their latching surfaces from the engagement members and thereby release the buckle. As in the case of U.S. Pat. No. 5,659,931, the function of coupling the buckle pieces together is performed exclusively by the cooperation between the tongues and the engagement members in the socket.

Although three-way buckles of the aforementioned type are suitable for children's seating, especially high chairs, one drawback associated with their use is that they are somewhat awkward to release. This difficulty is attributable to the nature of the latching mechanism, and in particular to the use of the tongues to accomplish this function. As discussed above, the tongues must be resiliently flexible so that they can flex over the stopping members or engagement members in the socket and then snap back into position. However, it is the nature of the tongues to not be that flexible because they are relatively large and are attached to the base of the plug members along a relatively long edge or surface thereof. The relatively great resistance of the tongues to flexing or bending, owing to their relatively long line of attachment to the base members, makes release of the buckle more difficult because a relatively large amount of force is necessary to disengage the latching surfaces of the tongues from the engagement members in the socket.

Another shortcoming of the three-way, simultaneous release buckles of the prior art is that the tongues do not provide for the best possible latching mechanism for the buckle. For example, in U.S. Pat. No. 5,709,014 the latching surface of the tongue is not aligned through the center axis of the tongue. Rather, the latching surface projects upwardly from the base of the tongue and is therefore spaced away from the central axis of the tongue. However, when a load or force is applied to the buckle, it will be appreciated that this force extends through the central axis of the tongues. A disadvantage of the latching mechanism of U.S. Pat. No. 5,079,014 is that because the latching surfaces of the tongue are not aligned with the central axis of the tongue, the latching mechanism does not act in alignment with and exactly opposite to the load force extending through the central axis of the tongues. This misalignment results in a somewhat diminished latching strength for buckles in general, as explained in my U.S. Pat. No. 5,794,316.

SUMMARY OF THE INVENTION

It is an object of the invention to provide a buckle which attaches straps in three different directions which is more easily releasable than the three-way buckles of the prior art.

It is a further object of the invention to provide a three-way buckle wherein the latching mechanism is more flexible than the tongues utilized in the prior art.

It is a further object of the invention to provide a three-way buckle which does not rely upon a tongue for performing the latching function.

It is another object of the invention to provide a three-way buckle which has an improved latching capability as compared to the three-way buckles of the prior art.

These and other objects of the invention are achieved by providing a three-way buckle having a socket member and a pair of plug members which may be coupled to the socket member, wherein the latching surfaces on the plug members are defined in resiliently flexible legs which extend from the base of the plug members. The latching surfaces are not defined on any tongues of the plug members. Preferably, each plug member has a pair of legs which project from the base of the plug, and each leg defines a latching surface near the distal end thereof. The socket member includes at least one post or other stopping member for engaging the latching surfaces of the legs in order to lock the plug members to the socket member. Preferably, there is a first post for engaging the legs of one of the plug members and a second post for engaging the legs of the other plug member, wherein each post is centrally situated so that it receives the legs on opposite sides thereof. Each pair of legs are spaced close enough together so that they do not fit on opposite sides of each post without bending. In this way, as a plug member is forced into the socket, the flexible legs will be forced to bend outward around the post until the plug is completely inserted into the socket, whereupon the latching surfaces of the legs will clear the post and the resiliently flexible legs will snap back into position around the post.

The plug members are simultaneously releasable from the socket because of the presence of a flap or push button which is defined in a top wall of the socket. The button includes a pair of releasing members, one releasing member for each pair of legs, which as they are pushed down into the socket are forced into a space between the legs, thereby forcing the flexible legs to bend outwardly. As the legs are forced outwardly, eventually their latching surfaces clear the post and the plug members are released from the socket. In order to facilitate this release, each post and each pair of legs are formed with cooperating inclined surfaces which allow for easy sliding movement over each other. Furthermore, the resiliently flexible nature of the legs will provide a gentle force upon disengagement of the latching surfaces from the post which causes each plug member to spring out of the socket. The button or flap is preferably coupled to a bottom wall of the socket member by a leaf spring which allows the button to be pushed down, but then return back to its original rest position for repeated use.

In a preferred embodiment, the latching surfaces defined on the legs of each plug member are V shaped and are adapted to engage with corresponding V shaped engaging surfaces on the post. This arrangement provides a latching surface area (i.e., the area of engagement between the latching surface of the legs and the engagement surface of the post) which is more evenly distributed around the top, bottom and side of each leg. This more even distribution of the latching surface area around the top, bottom and side of each leg is possible due to the generally V shape of the latching surface and the complementary V shape of the engagement surface of the post, and provides for stronger latching than the prior art.

Because the three-way buckle of the invention relies upon resiliently flexible legs for latching the plug members in the socket, as compared to the relatively inflexible tongues of the prior art, the invention affords more easy releasability of the buckle than the prior art.

BRIEF DESCRIPTION OF THE DRAWINGS

Various other objects, features and advantages of the invention will be more fully appreciated from the following detailed description of the preferred embodiments, when considered in connection with the accompanying drawings, in which like reference characters designate like or corresponding parts throughout the several views, and wherein.

DETAILED DESCRIPTION OF THE INVENTION

Figure 1:
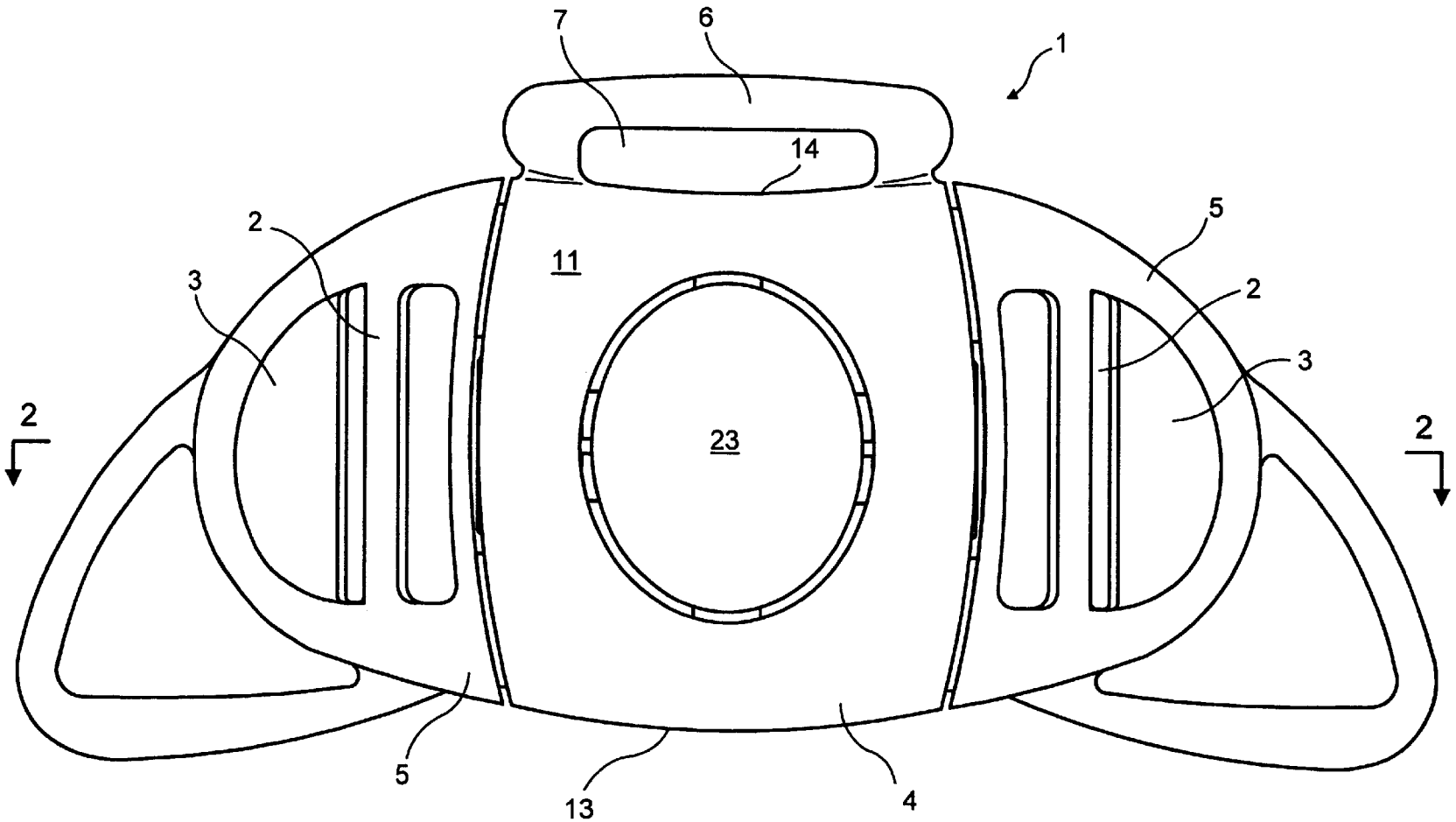
FIG. 1 is a top, planar view of a three-way buckle in accordance with the invention wherein the plug members are coupled to the socket member.
Figure 2:
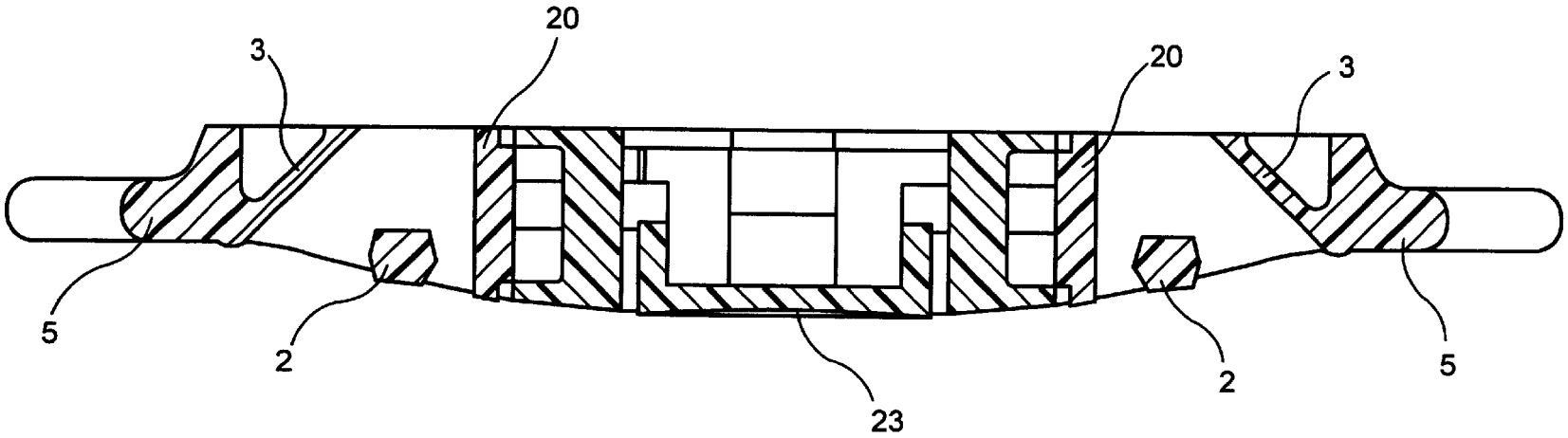
FIG. 2 is a cross-sectional view of the buckle of FIG. 1, taken along the line 2—2.
Figure 3:
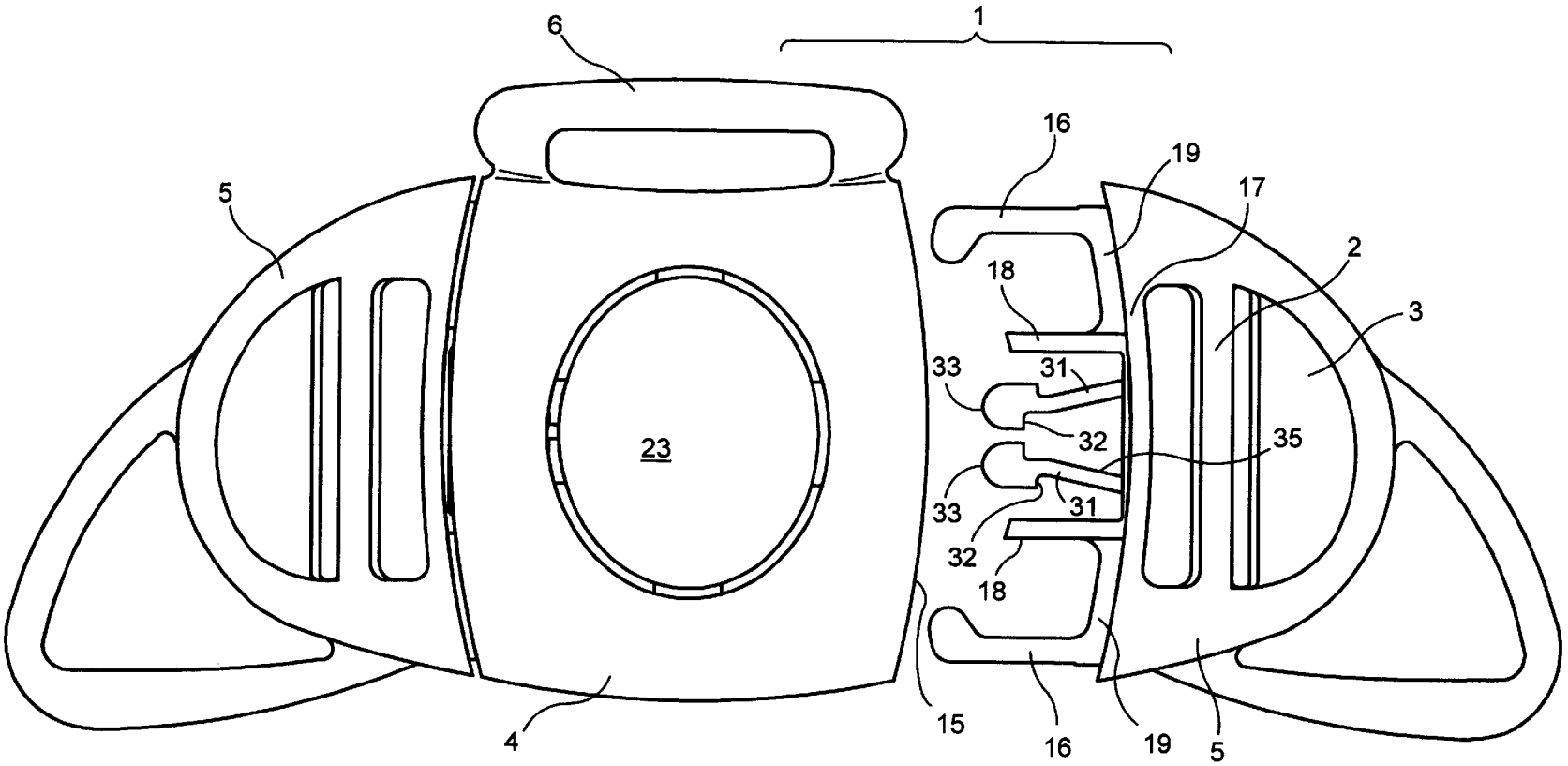
FIG. 3 is a partially exploded, top planar view of the buckle of FIG. 1, wherein one of the plug members is decoupled from the socket member.

Referring to FIGS. 1 and 3, a buckle in accordance with the invention is designated generally by the reference numeral 1. The buckle 1 is typically used to connect free ends of straps (not illustrated), especially for children's seating such as high chairs and the like. The buckle 1 is generally comprised of three pieces, a female socket member 4 and a pair of complementary male plug members 5. The buckle 1 and all of its component parts are preferably molded from a plastic or a resin, but any suitable material known in the art for molding or machining buckles may be used.

The socket member 4 is integrally molded with a single strap attachment bar 6 at one of its side walls 14. Bar 6 is spaced away from side wall 14 so as to define space 7 (see FIG. 1) for receiving the strap. A strap (not illustrated) can be looped around the bar 6 and then stitched to itself to permanently secure the strap to the bar. Each plug member 5 is integrally molded with a pair of cross bars 2 and 3 near its proximal end which can receive a strap in a well known manner such that the strap is adjustable, for example, as described in U.S. Pat. No. 5,216,786. It will be appreciated that when straps are attached to each of the plug members and to the socket member the straps will lead in three different directions, with the strap attached to bar 6 of socket member 4 being generally perpendicular to the direction of the straps attached to bars 2 and 3 of plug members 5. This three-way directional configuration renders the buckle particularly suitable for use in children's seating, especially high chairs. However, it will be appreciated that the number and arrangement of the cross bars is not critical and that they may be adjusted for different applications. For example, a pair of cross bars may be provided in lieu of the single bar 6 on the socket member 4 to allow for adjustability of the strap attached to the socket member, or the plug members 5 may be provided with only a single cross bar if adjustability of the straps attached to the plug members is not required or desired.

Figure 8B:
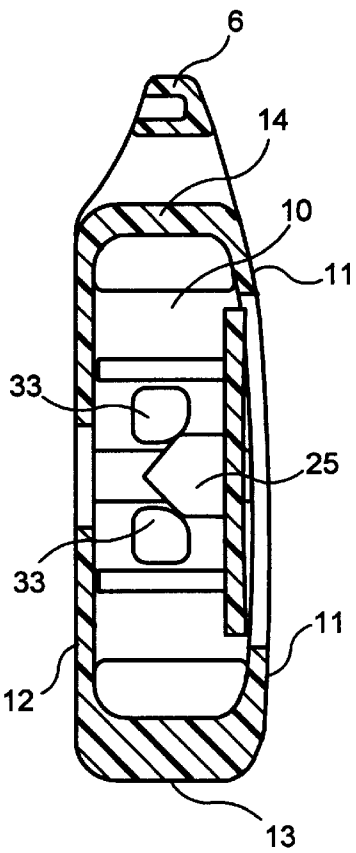
FIG. 8B is a cross-sectional view of the buckle illustrated in FIG. 5 as taken along the line 8B—8B.
Figure 8A:
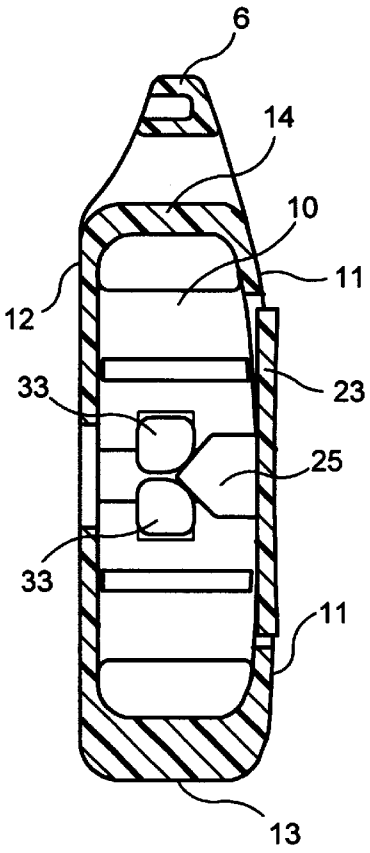
FIG. 8A is a cross-sectional view of the buckle illustrated FIG. 5 as taken along the line 8B—8B, except FIG. 8A assumes that the disengaging button has not been depressed.
Figure 7B:
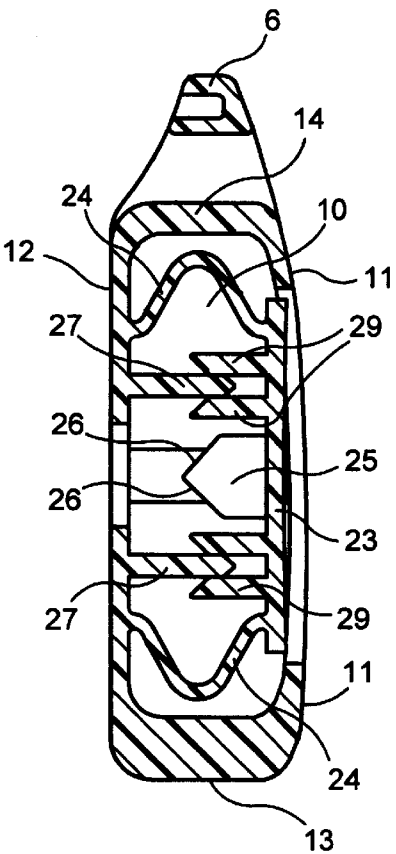
FIG. 7B is a cross-sectional view of the buckle illustrated in FIG. 5 as taken along the line 7B—7B.
Figure 7A:
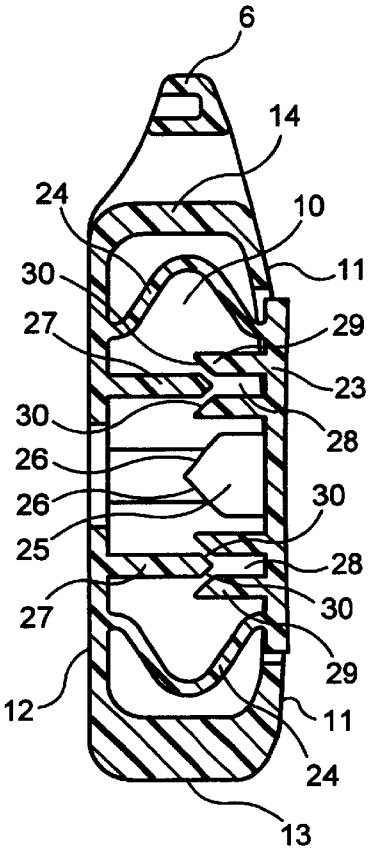
FIG. 7A is a cross-sectional view of the buckle illustrated in FIG. 5 as taken along the line 7B—7B, except FIG. 7A assumes that the disengaging button has not been depressed.

The socket member 4 preferably has a substantially flat rectangular tubular cross-sectional configuration as illustrated in FIGS. 7A and 8A, having a substantially rectangular shaped interior cavity 10. The cavity 10 is defined as the area or space between a top wall 11, and opposing bottom wall 12 and a pair of side walls 13 and 14, each of which connects the top wall 11 to the bottom wall 12 at the side edges thereof. The top and bottom walls 11 and 12 are typically much wider than the side walls 13 and 14, as illustrated in FIGS. 7A and 8A, so that the socket member has a substantially flat or rectangular shape.

As will be explained in detail below, each of the plug members 5 is received and releasably locked within the cavity 10 of the socket member 4 via latching surfaces 32 defined on locking legs 31 which are coupled to each plug member. The socket member 4 defines an opening 15 at its end thereof, between the side walls 13 and 14 and the top and bottom walls 11 and 12, which opens the socket member to the interior cavity 10 (see FIG. 3). Each opening 15 permits the socket member 4 to receive a portion of a plug member 5 for coupling the plug members to the socket member.

To facilitate in guiding the plug members 5 as they are inserted into the cavity 10 of the socket member 4, each plug member 5 is provided with a pair of guide legs 16 (see FIGS. 3–6) which project from a base portion 17 of the plug member 5 in a direction generally parallel to each other. The guide legs 16 are spaced far apart from one another such that when inserted into the cavity 10 of the socket member 4 they just touch the inner surface of the side walls 13 and 14 of the socket member 4. In this way, the cooperation between the guide legs 16 and the side walls 13 and 14 guide the plug members 5 to a proper position and fit within the socket member 4. The guide legs 16 also function to help prevent lateral movement and sway of the plug members 5 when they are coupled to the socket member 4 since their lateral movement is restricted by the confines of the side walls 13 and 14 of the socket. In addition, each plug member 5 may be provided with a pair of auxiliary guide bars 18 projecting from base portion 17 for further facilitating the guiding of the plug members 5 into cavity 10. These auxiliary guide bars 18 may be adapted to slide into shallow grooves or channels (not illustrated) defined on the inner surfaces of the top and bottom walls 11 and 12 of the socket member 4 for proper positioning of the plug member and the socket member. In addition, the height of the guide leg 16 and auxiliary guide bars 18 is such that they just touch the top and bottom walls 11 and 12 of the socket member 4 when inserted into the socket member to prevent vertical movement and sway of the plug members 5 when they are coupled to the socket member 4. A fitting member 19 may also be provided near the base 17 of each plug member 5 which is sized so as to just fit snuggly within the top and bottom walls 11 and 12 of the socket member 4, again for preventing vertical movement and sway of the plug members 5 when they are coupled to the socket member 4.

Figure 4:
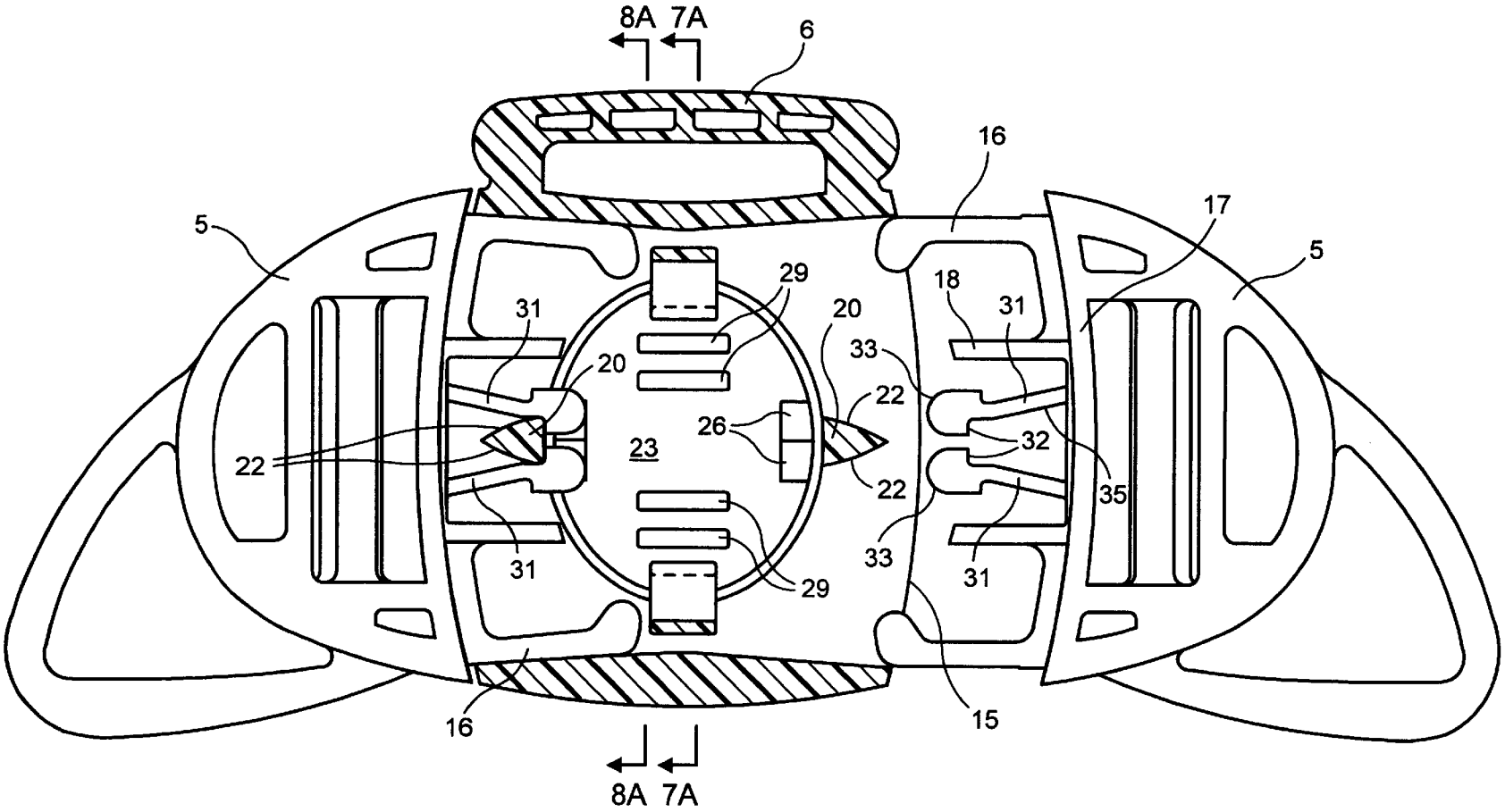
FIG. 4 is a cross-sectional view of the buckle of the invention as seen looking from the bottom of the buckle to the top of the buckle, wherein one of the plug members is coupled to the socket member and the other plug member is decoupled from the socket member.
Figure 5:
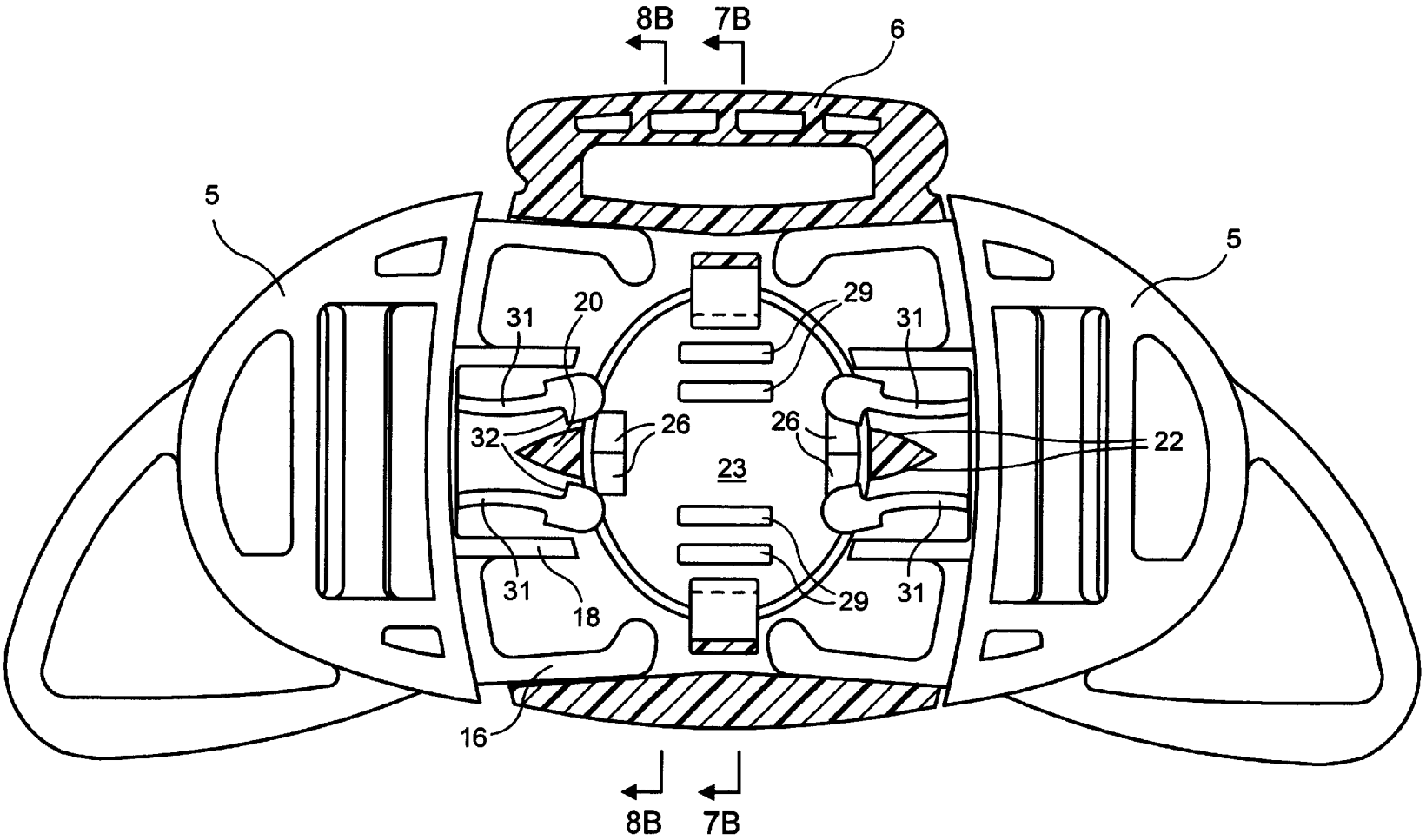
FIG. 5 is a cross-sectional view of the buckle of the invention as seen looking from the bottom of the buckle to the top of the buckle, wherein each of the plug members are in different states of being disengaged from the socket member.
Figure 6:
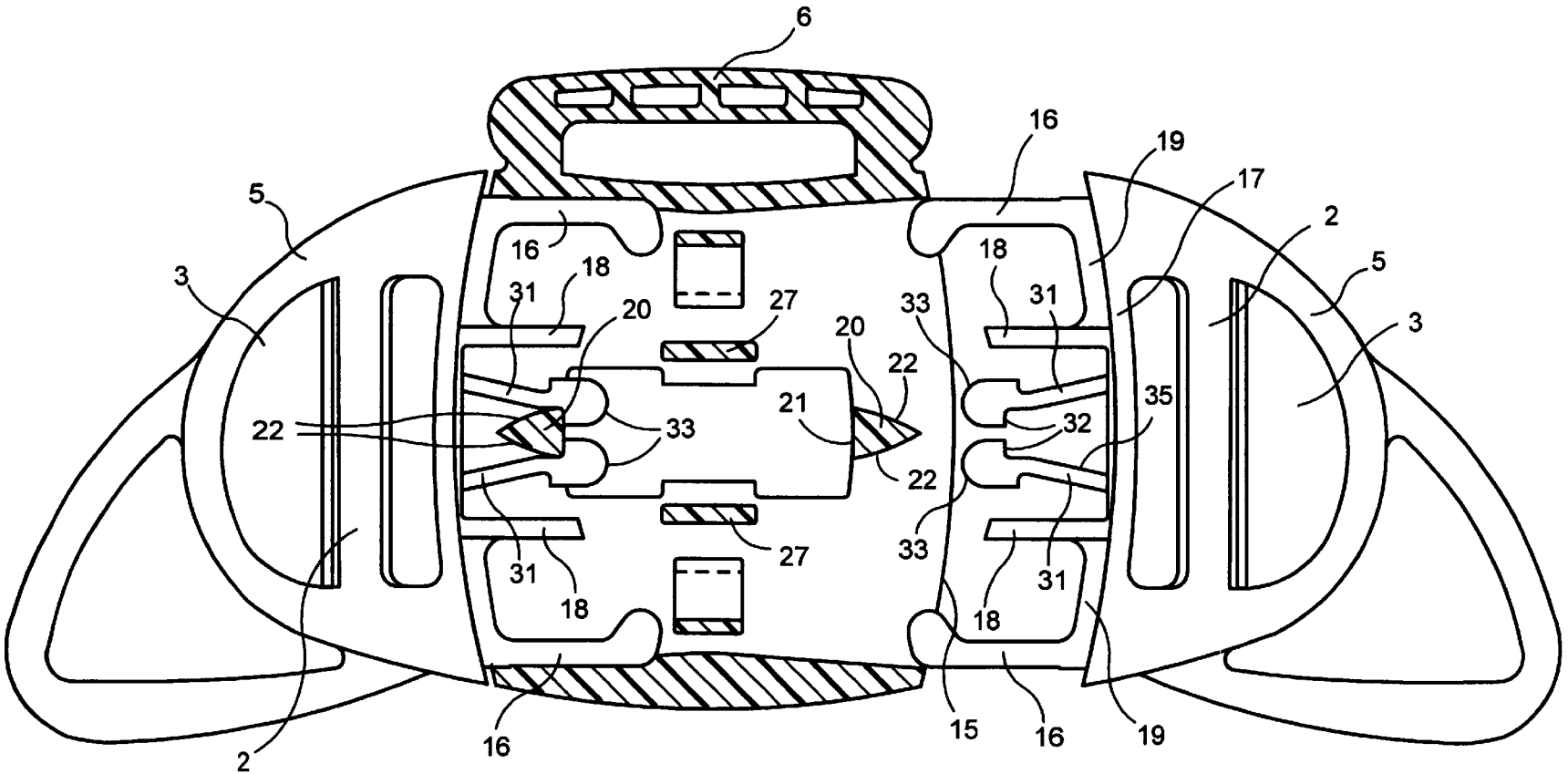
FIG. 6 is a cross-sectional view of the buckle of the invention as seen looking from the top of the buckle to the bottom of the buckle, wherein one of the plug members is coupled to the socket member and the other plug member is decoupled from the socket member.

In order to retain and lock the plug members 5 in the socket member 4, there is provided a stopping post 20 which extends between the inner surfaces of the top and bottom walls 11 and 12 in the vicinity of each of the two openings 15 of the socket member 4. Each of the two stopping posts 20 defines an engaging surface 21 which faces toward the interior of cavity 10 and a pair of angled surfaces 22 which face the aperture 15 of the socket member 4 (see FIGS. 4–6). As illustrated in FIGS. 4–6, the surfaces 22 are angled such that they become wider apart in the direction from the opening 15 to which they are closest toward the center of cavity 10 of socket member 4 (i.e., they are tapered in the direction from the center of cavity 10 in the direction toward the closest opening 15).

A push button 23 is cut away in the top wall 11 of the socket member 4. The push button 23 is coupled to the socket member 4 by a pair of leaf springs 24 or the like (see FIGS. 7A and 7B) which attach the push button 23 to the bottom wall 12 of the socket member. The leaf springs 24 are flexible and permit the push button 23 to be pushed downward into the interior cavity 10 of the socket member 4. However, because of the shape memory of the leaf springs 24, they will resume their original shape and position once force on the push button 23 is removed. It will be appreciated that the pair of leaf springs 24 is only exemplary, and that other shape memory members may be used to attach the push button 23 to the socket member 4. For example, a single leaf spring may be used to attach push button 23 to one of the side walls 13 or 14, or other types of parts for actuating push buttons or the like may be used with push button 23. All that is necessary is that it be possible for button 23 to be pushed downward into the interior cavity 10 and then resume its original position once force on the button is removed.

Push button 23 is provided with a pair of disengaging members 25 which project from the button 23 into the interior cavity 10 of the socket member 4 (see FIGS. 7A–8B). Each disengaging member 25 defines a pair of angled surfaces 26 at its distal end which face toward the center of interior cavity 10. The surfaces 26 are tapered in the direction from the push button 23 toward the center of interior cavity 10 and preferably form an apex, as illustrated in FIGS. 7A and 7B.

In order to ensure straight vertical movement of the push button 23 and proper positioning of the disengaging members 25 as the push button 23 is pushed down into the interior cavity 10, the socket member 4 is provided with guide walls 27 (see FIGS. 7A and 7B) which project upwardly from the bottom wall 12 of the socket member 4 into the interior cavity 10. The guide walls 27 are adapted to engage guide channels 28 which are defined between guide walls 29 which project from push button 23 downwardly into interior cavity 10 (see FIGS. 7A and 7B). As illustrated in FIGS. 7A and 7B, the distal ends of the guide walls 27 and 29 have cooperating angled surfaces 30 which will permit easy sliding of the walls 27 into the channels 28 between walls 29 in the event there is a minor misalignment as the push button 23 is pushed downward.

Each plug member 5 is provided with a pair of locking legs 31 which project from base portion 17 (see FIGS. 4–6). The locking legs 31 are preferably integrally formed with the base portion 17 of the plug member 5, and, as can be seen from FIGS. 4–6, are relatively thin as compared to the full length of the base portion 17. In this way, the locking legs 31 are relatively flexible. Yet, because they are integrally molded with the base portion 17, they are resilient enough to exhibit shape memory, i.e. they will return to their original position after bending force on them is removed. Each locking leg 31 defines a latching surface 32, preferably near the distal end 33 of the leg. In the embodiment of FIGS. 1–8, the latching surface 32 is transverse and generally perpendicular to the insertion direction of the plug member 5 and the longitudinal axis of the leg 31. In this way, the latching surface 32 is adapted to engage the engagement surface 21 of the post 20 in the socket member 4 when the plug member 5 is fully inserted into the socket member 4. The distal end 33 of each locking leg 31 preferably has a bulbous shape for reasons which will become apparent hereinafter.

Referring to FIGS. 3, 4 and 6, in order to couple each plug member 5 to the socket member 4, the guide legs 16, auxiliary guide bars 18 and locking legs 31 of each plug member are inserted into opposite openings 15 in the socket member 4. The position of guide legs 16, and optionally auxiliary guide bars 18, ensure that the locking legs 31 will be guided around post 20, on opposite sides thereof. As the legs 31 are inserted into the cavity 10, the distal end—bulbous region 33 of each leg will make contact with one of the inclined surfaces 22 of the post 20. As the legs 31 are forced around the inclined surfaces 22 by continued insertion of the legs 31 into the cavity 10, legs 31 will diverge apart because of the divergence of surfaces 22. The flexible nature of the legs 31 will permit the divergence. The divergence will continue until latching surfaces 32 clear the end of the post 20, at which point the legs 31 will be free to snap back inward, thereby engaging the latching surfaces 32 on the engagement surface 21 of the post 20. It is the resilient, shape memory nature of the legs 31 which will cause them to snap back after the latching surfaces 32 clear the post 20. It will be appreciated that when the latching surfaces 32 engage the engagement surface 21, the guide legs 16, auxiliary guide bars 18 and the locking legs 31 will be fully inserted into the socket member 4 and the plug member 5 will be coupled to the socket member 4. The engagement of the latching surfaces 32 and engagement surface 21 will lock the plug member 5 to the socket member 4 and prevent separation of the buckle pieces, as seen in FIGS. 4 and 6.

In order to disengage each plug member 5 from the socket member 4, one must push down on the push button 23. Referring to FIGS. 5 and 7–8, as this occurs the disengaging members 25 will be forced downward so as to push inclined surfaces 26 into contact with the bulbous distal ends 33 of the locking legs 31 (see the position of the locking legs 31 on the right plug member in FIG. 5). Continued downward pushing of the push button 23 will force the locking legs 31 to flex and diverge laterally outward because of the angled surfaces 26 pushing outward on the bulbous regions 33 of the legs (see the right plug member in FIG. 5 and the cross-sectional view in FIG. 8B). It will be appreciated that the legs 31 will continue to be forced laterally outward until the latching surfaces 32 clear the engagement surface 21 of the post 20. At such time, the bulbous distal ends 33 of the legs 31 will slide along the inclined surfaces 22 of the post 20, and the resilient shape memory nature of the legs 31 and their desire to return to their original, non-flexed position will cause the plug member 5 to spring out of the socket member 4 (see the plug member on the left side in FIG. 5). It will be appreciated that simultaneous release of both plug members 5 is achieved because movement of the push button 23 forces both disengaging members 25 downward simultaneously so as to diverge each pair of locking legs 31. Because of the shape memory nature of the leaf springs 24 which couple the push button 23 to the socket member 4, the push button 23 will return to its original, non-depressed position after pressure on the button is removed. It will be appreciated that as the button 23 is pushed downward, the disengaging members 25 will be properly targeted and aligned such that surfaces 26 will be moved between the distal ends 33 of the locking legs 31 because the guide walls 27 will be forced into the guide channel 28 and restricted from lateral movement by guide walls 29, thereby insuring straight vertical movement of the pushed button and the disengaging members 25.

It will be appreciated by those skilled in the art from the above disclosure that the number and arrangement of posts 20 provided in the socket member 4 of the buckle is not critical and may vary. For example, a total of four posts may be provided, wherein each post engages just one of the four locking legs. Alternatively, a single post may be provided which is especially adapted with four engaging surfaces, each of which engages one of the locking legs. It will also be appreciated by those skilled in the art from the above disclosure that the direction in which the locking legs 31 flex when engaging and disengaging the post is not critical and may vary from the direction described above. For example, the posts, their engaging surfaces, the locking legs and their latching surfaces may readily be reconfigured such that the locking legs will be forced closer together (i.e., converged) when inserted into the socket member, rather than diverge as in the embodiment described above. In this variation, upon actuation of the push button 23, the locking legs will converge in order to disengage their latching surfaces from the engagement surfaces on the post, rather than diverge as in the embodiment described above. It will be appreciated by those skilled in the art that many additional variations and modifications may be made to the buckle of the invention without departing from the complete scope of the invention.

Figure 9:
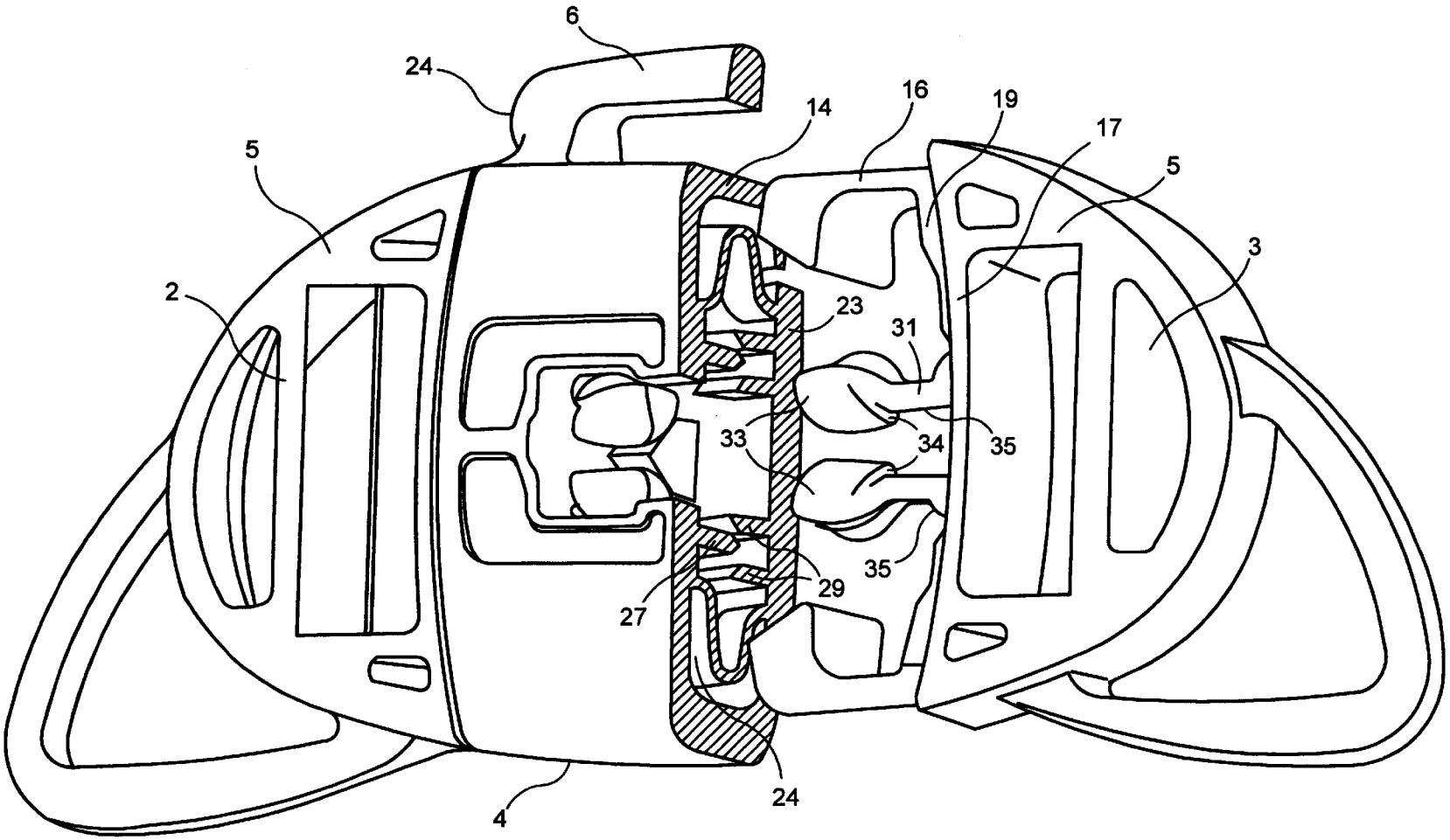
FIG. 9 is a perspective view of a three-way buckle in accordance with another embodiment of the invention wherein a portion of the socket member is cut away so as to fully expose one of the plug members.
Figure 10:
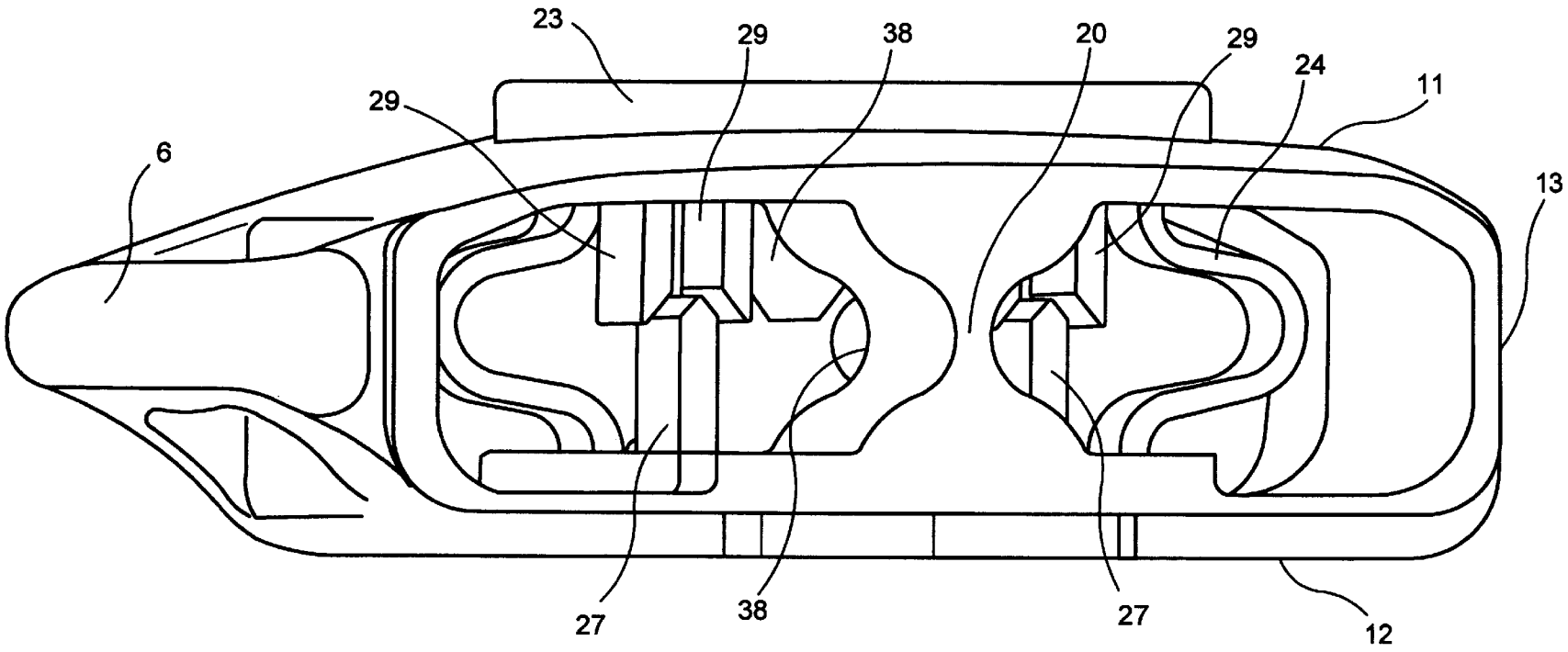
FIG. 10 is a cross-sectional view of the socket member of the buckle of FIG. 9 as taken along the line 10—10, wherein the plug members are decoupled from the socket member.

A preferred embodiment of the invention having improved latching capability is illustrated in FIGS. 9 and 10. This embodiment of the invention is identical in every way to the embodiment of FIGS. 1–8, except for the geometry of the latching surfaces 34 defined on the locking legs 31 and the geometry of the complementary engagement surface 38 defined on the posts 20. Like reference numerals in FIGS. 9 and 10 denote like parts in the embodiment of FIGS. 1–8, and reference should be made to the discussion above for a description and explanation of these parts.

Referring to FIGS. 9 and 10, the latching surface 34 is defined near the distal end 33 of each locking leg 31 and is transverse to the insertion direction of the plug member 5 and the longitudinal axis of leg 31. The latching surface 34 has a V like shape such that the latching surface 34 extends around the top, side 35 and bottom of the locking leg 31. It can be seen from FIG. 9 that the apex of the V shaped latching surface 34 is at the side 35 of the locking leg 31. Likewise, the engagement surfaces 38 which are defined in the post 20 have a complementary V like shape (see FIG. 10) such that they can cleanly mate with the latching surfaces 34 defined in the locking legs 31. In all other respects, the structure of the three-way buckle of the embodiment of FIGS. 9 and 10 is identical to that of the embodiment of FIGS. 1–8. Furthermore, the function and operation of three-way buckle of FIGS. 9 and 10 is identical to that of FIGS. 1–8, and the plug members 5 are coupled to and decoupled from the socket member 4 in the same way as the buckle of FIGS. 1–8.

It will be appreciated that because the latching surface 34 defined in each locking leg 31 has substantially a V shape, with the apex of the V shape at the side 35 of the locking leg 31, the latching surface 34 extends around the top, side 35 and bottom of the locking leg 31. On the other hand, in the embodiment of FIGS. 1–8, it can be seen that the latching surface 32 extends only along the side 35 of the locking legs 31, but not along the top or bottom of the leg 31. Accordingly, the embodiment of FIGS. 9 and 10 has a more evenly distributed latching surface area around the top, side 35 and bottom of the locking legs 31 which results in a more evenly distributed latching resistance force when a load is applied to the buckle. This more evenly distributed latching resistance force results in a greater latching strength for the buckle which is embodied in FIGS. 9 and 10.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A buckle comprising:

a socket member having an obverse face and a pair of sides, wherein the obverse face and the sides define a socket therebetween, the socket member having a first open end and a second open end;

a button belonging to the socket member, the button being depressible in a first direction to a location in which at least a portion of the button projects inside the socket;

at least one engaging member disposed in the interior of the socket;

a first plug member and a second plug member, each plug member having a base portion and at least one resiliently flexible leg extending from the base portion, said at least one resiliently flexible leg defining a latching surface thereon, said at least one resiliently flexibly leg permitting movement of the latching surface in at least one second direction, each of the at least one second direction being non-parallel to the first direction;

wherein the socket member is adapted to slidably receive the legs of the plug members through the open ends of the socket member so as to couple the plug members to the socket member, and wherein said at least one engaging member of the socket member engages the latching surfaces of the legs of the first and second plug members to lock the plug members to the socket member when the plug members are coupled to the socket member, and wherein the plug members may be unlocked from the socket member by depressing the button in the first direction toward the interior of the socket so as to disengage the latching surfaces from the at least one engaging member in one of the at least one second direction and thereby permit decoupling of the plug members from the socket member.

2. The buckle according to claim 1, wherein the button includes a first disengaging member for disengaging the latching surface defined on each of the at least one resiliently flexible leg belonging to the first plug member from the at least one engaging member and a second disengaging member for disengaging the latching surface defined on each of the at least one resiliently flexible leg belonging to the second plug member from the at least one engaging member.

3. The buckle according to claim 2, wherein the at least one resiliently flexible leg belonging to the first plug member includes a pair of resiliently flexible legs, and wherein the at least one resiliently flexible leg belonging to the second plug member includes a pair of resiliently flexible legs.

4. The buckle according to claim 3, wherein the first disengaging member diverges the legs belonging to the first plug member and the second disengaging member diverges the legs belonging to the second plug member upon depression of the button.

5. The buckle according to claim 1, wherein the button includes at least one disengaging member for disengaging the latching surfaces of the legs from the at least one engaging member.

6. The buckle according to claim 5, further comprising means for guiding movement of the at least one disengaging member toward the legs.

7. The buckle according to claim 6, wherein the means for guiding includes a pair of guide walls which project upwardly from a bottom wall of the socket member into the socket and a pair of guide channels defined on an inner surface of the button which are adapted to receive the guide walls upon depression of the button.

8. The buckle according to claim 1, wherein the at least one engaging member is a post having an engagement surface which engages the latching surface of at least one of the legs when the plug members are coupled to the socket member.

9. The buckle according to claim 1, wherein each plug member has a pair of resiliently flexible legs extending from the base portion of the plug member, each of said legs defining a latching surface thereon.

10. The buckle according to claim 9, wherein the button includes a disengaging member which forces the pair of legs of at least one of the plug members away from the at least one engaging member upon depression of the button so as to disengage the latching surfaces of the legs from the at least one engaging member.

11. The buckle according to claim 9, having a first engaging member and a second engaging member, wherein the latching surfaces defined on the pair of legs belonging to the first plug member engage the first engaging member and the latching surfaces defined on the pair of legs belonging to the second plug member engage the second engaging member when the plug members are coupled to the socket member.

12. The buckle according to claim 4, wherein the button includes at least one disengaging member which disengages the latching surfaces of each pair of legs from the first and second engaging members upon depression of the button.

13. The buckle according to claim 9, wherein the button includes a first disengaging member for disengaging the latching surfaces defined on the pair of legs belonging to the first plug member from the at least one engaging member and a second disengaging member for disengaging the latching surfaces defined on the pair of legs belonging to the second plug member from the at least one engaging member, wherein the first and second plug members are simultaneously decoupled from the socket member upon depression of the button.

14. The buckle according to claim 13, wherein the first disengaging member diverges the legs belonging to the first plug member and the second disengaging member diverges the legs belonging to the second plug member upon depression of the button.

15. The buckle according to claim 14, wherein each of the first and second disengaging members defines inclined surfaces at a distal end of the disengaging member, wherein said inclined surfaces diverge the legs of the plug members upon depression of the button.

16. The buckle according to claim 14, wherein the latching surface defined on each leg of each plug member is substantially V shaped.

17. The buckle according to claim 1, wherein the latching surface of the at least one leg belonging to the first plug member and the latching surface of the at least one leg belonging to the second plug member are simultaneously disengaged from the at least one engaging member upon depression of the button toward the interior of the socket.

18. The buckle according to claim 1, wherein the latching surface of the at least one leg of each plug member is defined along a side of the at least one leg.

19. The buckle according to claim 18, wherein the latching surface of each leg is transverse to a longitudinal axis of the leg.

20. The buckle according to claim 1, wherein the latching surface defined on the at least one leg of each plug member is substantially V shaped.

21. The buckle according to claim 1, wherein the latching surface of the at least one leg of each plug member extends around a top, a side and a bottom of the leg.

22. The buckle according to claim 21, wherein the latching surface of the at least one leg of each plug member extends around a top, a side and a bottom of the leg so as to define a V shape, wherein the V shaped latching surface has an apex at the side of the leg.

23. The buckle according to claim 22, Wherein the at least one engaging member defines an engagement surface which is V shaped for engaging the V shaped latching surface.

24. The buckle according to claim 1, wherein the button is coupled to the socket member by at least one leaf spring.

25. The buckle according to claim 24, wherein the button is coupled to a bottom wall of the socket member by a pair of leaf springs.

26. The buckle according to claim 1, wherein each plug member includes at least one guide leg which makes contact with an inner surface of one of the sides of the socket member when the plug members are coupled to the socket member.

27. The buckle according to claim 26, wherein each plug member includes a pair of guide legs projecting from the base portion, wherein each guide leg makes contact with an inner surface of one of the sides of the socket member when the plug members are coupled to the socket member.

* * * * *

UNITED STATES PATENT AND TRADEMARK OFFICE

CERTIFICATE OF CORRECTION

PATENT NO. : 6,408,494 B1
DATED : June 25, 2002
INVENTOR(S) : Joseph Anscher

It is certified that error appears in the above-identified patent and that said Letters Patent is hereby corrected as shown below:

Column 5,
Line 62, “snuggly” should be -- snugly --.

Column 10,
Line 39, “4” should be -- 11 --.

Signed and Sealed this

Twenty-seventh Day of July, 2004

JON W. DUDAS
*Acting Director of the United States Patent and Trademark Office*